US006280345B1

(12) United States Patent
St. Martin

(10) Patent No.: US 6,280,345 B1
(45) **Date of Patent: *Aug. 28, 2001**

(54) BALL SUPPORT AND GOLF SWING AID FOR GOLF PRACTICE

(76) Inventor: Kirk D. St. Martin, 5464 W. Everett Ave., Fresno, CA (US) 93722

( * ) Notice: Subject to any disclaimer, the term of this patent is extended or adjusted under 35 U.S.C. 154(b) by 0 days.

This patent is subject to a terminal disclaimer.

(21) Appl. No.: 09/273,852

(22) Filed: Mar. 22, 1999

Related U.S. Application Data

(63) Continuation of application No. 08/851,358, filed on May 5, 1997, now Pat. No. 5,885,167.
(60) Provisional application No. 60/100,527, filed on Sep. 16, 1998.

(51) Int. Cl.[7] ..... A63B 69/36
(52) U.S. Cl. ..... 473/278
(58) Field of Search ..... 473/278, 279, 473/387, 388

(56) References Cited

U.S. PATENT DOCUMENTS

| | | | | |
|---|---|---|---|---|
| 1,783,211 | | 12/1930 | Baldwin . | |
| 3,423,096 | | 1/1969 | Tone . | |
| 3,934,882 | * | 1/1976 | Whittaker | 473/278 |
| 5,383,668 | * | 1/1995 | Andrikian | 273/201 |
| 5,503,396 | | 4/1996 | Veylupek . | |
| 5,577,967 | * | 11/1996 | Durso | 473/279 |
| 5,630,719 | * | 5/1997 | Franklin | 473/278 |
| 5,676,604 | * | 10/1997 | McCormick | 473/263 |
| 5,690,557 | * | 11/1997 | Casillas et al. | 473/278 |
| 5,720,677 | * | 2/1998 | Rudduck | 473/387 |
| 5,803,826 | * | 9/1998 | Perrine | 473/278 |
| 5,885,167 | * | 3/1999 | St. Martin | 473/278 |

* cited by examiner

*Primary Examiner*—Mark S. Graham
*Assistant Examiner*—Raeann Gorden
(74) *Attorney, Agent, or Firm*—Richard A. Ryan

(57) ABSTRACT

A golf ball support and golf swing aid for golf practice that has a generally flat rectangular base made of a resiliently deformable material, such as found with some plastics, that enables the golfer to bend the base into a convex shape, forming an arch-like profile. The base has a smooth upper surface and a alignment guide to denote the preferred direction of golf ball travel. A recess located on the base holds a golf ball in position on the base. The arch-like profile allows the golfer to use the golf aid to practice golf swings on any type of terrain, including rocky, barren and asphalt covered areas. The resiliently deformable material provides the golfer with a cushioned, spring-like resistance that prevents or reduces the amount of jarring shock experience by the golfer, while simulating the feel of a golf swing on a natural fairway and protecting the turf. A channel cut into the top surface of the base can be utilized to place the ball on the recess. A stake specially made for the base can hold the base down to prevent forward movement of the base due to a short swing. Various markings can be placed on the top surface of the base to assist the golfer and provide assistance for the golfer with regard to different golf swings. The golf ball support is inexpensive to make, easy to transport and easy to use.

20 Claims, 3 Drawing Sheets

BALL SUPPORT AND GOLF SWING AID FOR GOLF PRACTICE

CROSS-REFERENCE TO RELATED APPLICATIONS

This application is a continuing application of U.S. patent application Ser. No. 08/851,358 filed May 5, 1997, issued as U.S. Pat. No. 5,885,167 on Mar. 23, 1999, and claims the benefit of U.S. Provisional Patent Application No. 60/100,527, filed Sep. 16, 1998.

BACKGROUND OF THE INVENTION

1. Field of the Invention

The present invention relates generally to ball supports specially adapted for practicing golf. More particularly, the present invention relates to golf ball supports incorporated within a base that protect the ground surface from damage and the golfer from injury due to jarring. Even more particularly, the present invention relates to lightweight ball supports that provide a golfer with a golf ball support which allows the golfer to practice on rough surfaces and which incorporates a golf swing aid.

2. Background

In a common golf practice situation, the golfer wants to be able to stand in one place and practice hitting a golf ball in a certain direction. Depending on the type of golf club being used, the golf ball is either placed on the ground or on a conventional golf tee. When the ball sits on the ground, it is not uncommon that the ground around the ball is damaged by the golf club. Even if the golfer is using a tee, damage to the ground can result when the golfer misses and hits "short" of the ball. Because of the potential for turf damage, golf practice is banned on many fields, such as school yards and parks. As a result of such banning and the general unavailability of good turf areas, the golfer is often forced to practice in an area not having a good turf surface. At other times, the golfer may desire to practice at a location which is convenient to him or her, but which does not have a good playing surface, including locations with such surfaces as rocky or barren terrain, including asphalt. If the golfer is practicing on a non-turf area, a missed swing can result in damage to the club head and a substantial jarring shock to the golfer.

The use of a specially designed base from which a golf ball is hit is well known in the art. Generally, the golf ball support base is utilized during golf practice to serve a variety of purposes, such as protecting the turf below the support and providing a means for monitoring the golfer's swing. The prior golf practice bases are beset with a number of problems, including lack of wear resistance, inability to function on a surface that is not relatively smooth and devices which subject the golfer to a jarring shock when he or she makes a poor swing. In an attempt to address these problems and to provide a practice guide, a number of devices have been developed which are difficult to transport, expensive to manufacture and difficult to use, resulting in such devices being generally disfavored by golfers.

SUMMARY OF THE INVENTION

The ball support and golf swing aid in accordance with the present invention solves the problems associated with the prior golf practice bases described above. That is to say, the present invention provides a golf ball support base that is easily transportable, inexpensive to manufacture and easy to use. Specifically, the ball support and golf swing aid of the present invention utilizes a lightweight, resiliently deformable base that supports a golf ball above virtually any type of surface from which a golfer would want to practice his or her golf swing. In its preferable forms, the present invention contains no metal parts that may corrode or damage golf club heads or golf balls. It can be seen from the following discussion that the present invention provides a novel golf ball support base and golf swing aid for practicing golf.

The ball support and golf swing aid of the present invention has a substantially flat base which is preferably made of a lightweight, durable plastic or plastic-like material that is cut into a generally elongated or rectangular shape. In its preferred embodiment, the base of the present invention is made from a relatively thin (i.e., approximately one-eighth inch thick) plastic that is capable of being placed into a convex shape by the golfer, creating an arch-like profile, when desired for certain practice techniques and then placed back in a flat condition for other practice techniques and transport. The top surface of the base is smooth to allow a golf club head to slide over the surface with a minimum amount of friction.

Cut into the top surface of the base is a recess having a diameter and depth sufficient to keep a golf ball from falling off the top surface of the base when it is in either a flat or convex condition. In the preferred embodiment, the recess is placed at or near the center of the base. In this configuration, when the golfer bends the base in a convex shape, the golf ball will be raised above the ground surface in an amount selected by the golfer. The bottom of the recess can comprise a hole cut through the base to allow the insertion of a conventional golf tee therein. In the preferred embodiment, the base also comprises a golf tee opening located generally forward (i.e., the direction of the golf ball travel) of the recess. To reduce the likelihood of damage to the golf tee, the opening can be rectangularly shaped to allow the tee to fall over instead of break when the golfer hits the ball.

To assist the golfer in improving his or her golf swing, the present invention is provided with one or more alignment lines that denotes the preferred direction of travel for a golf ball hit from the base. The alignment line or lines are aligned with the intended direction of travel for the golf ball. In the preferred embodiment, the alignment comprises a pair of alignment lines on either side of the recess that extend approximately the entire longitudinal length of the base to provide a relatively easy means for the golfer to ensure that the longitudinal axis of the base is aligned with where the golfer wants the ball to travel (i.e., toward the hole, etc.) The alignment lines can be material placed on the top surface of the base, made integral with the base or imbedded into the base, the important feature being that it allows the golfer to align the base and not damage the alignment line during use. The alignment can, alternatively, comprise a single alignment line centrally located along the longitudinal axis of the base. The line can be a single strip of plastic tape placed on the bottom of the base to prevent the golf club head from damaging the alignment line during use. In order for the alignment line to be useful from the bottom of the base, the base should be made of a translucent material that allows the golfer to see the alignment line during a swing.

To facilitate placement of the ball onto the base without the golfer having to bend over and lift the ball onto the recess for every shot, the present invention can include a ball placement mechanism that allows the golfer to slide the golf ball with his or her golf club along the base and onto the recess. One such mechanism is the use of a channel cut into the top surface of the base that extends from one or more ends of the base to the recess. An entry port cut into the end where the channel meets the end facilitates entry of the ball onto the channel. The ends of the base can be convexly shaped to facilitate the base staying in place when the golfer hits a ball off the base. The sides of the base can be concavely shaped to assist the golfer with alignment and rotation of his or her body during the shot. The top surface of the base can also comprise a number of shot marks that allow the golfer to work the ball and practice shots that are other than straight along the longitudinal axis of the base.

The present invention also describes an additional mechanism for keeping the base in place during golf practice. As is known, some shots can be short of the ball. If the present invention is being used, a short shot can result in the present invention moving or flying forward of the golfer. Although the convex shape and flexible nature of the base will generally keep the invention in place during most shots, a hard short shot will tend to result in movement of the base. To prevent this movement, the golfer can anchor the base to the ground surface utilizing small plastic stakes or conventional golf tees. The stakes can be generally conically shaped to facilitate entry into the ground and have part of the side cut out so that the stake will abut against the top of the base to hold it in place. The base can be configured to facilitate use of the stakes by having one or more small circular base areas cut into each end of the base for placement of the stakes.

Accordingly, the primary objective of the present invention is to provide a ball support and golf swing aid for golf practice of the character described herein, wherein the base is made from a durable, lightweight and resiliently deformable material suitable for placing the base in a convex, arch-like shape while supporting a golf ball for use by a golfer on any type of surface from which the golfer would want to practice his or her golf swing.

It is also an important objective of the present invention to provide a ball support and golf swing aid that prevents or reduces the effects from jarring and simulates the feel of hitting a golf ball on natural turf.

Another important objective of the present invention is to provide a ball support and golf swing aid that has one or more alignment lines which denote the preferred direction of golf ball travel to indicate to the golfer the direction he or she should be aiming.

Yet another important objective of the present invention is to provide a ball support and golf swing aid that has a ball placement mechanism for assisting the golfer in placing the golf ball on the recess cut into the top surface of the base.

Yet another important objective of the present invention is to provide a ball support and golf swing aid that will not damage the golf club or golf ball during use.

Yet another important objective of the present invention is to provide a ball support and golf swing aid that is inexpensive to manufacture, easily transported and easy for the golfer to use.

Yet another important objective of the present invention is to provide a ball support and golf swing aid that has shot marks and/or sides that are configured to assist the golfer with improving his or her golfing ability.

Yet another important objective of the present invention is to provide a ball support and golf swing aid that includes a small stake for holding the base in place in case the golfer hits the base to prevent unwanted forward movement of the base.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
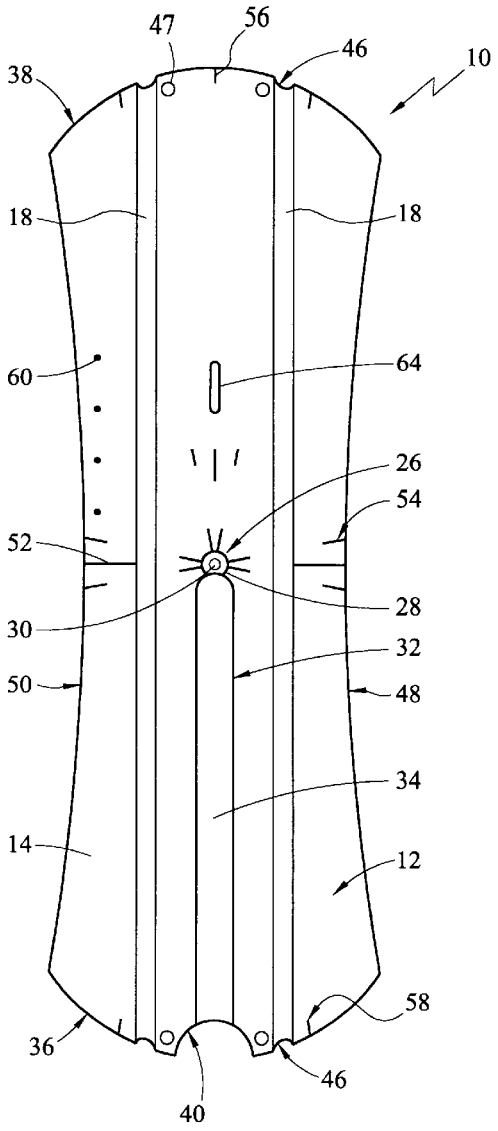
FIG. 1 is a top view showing a ball support and golf swing aid embodying the principles of the present invention.
Figure 2:
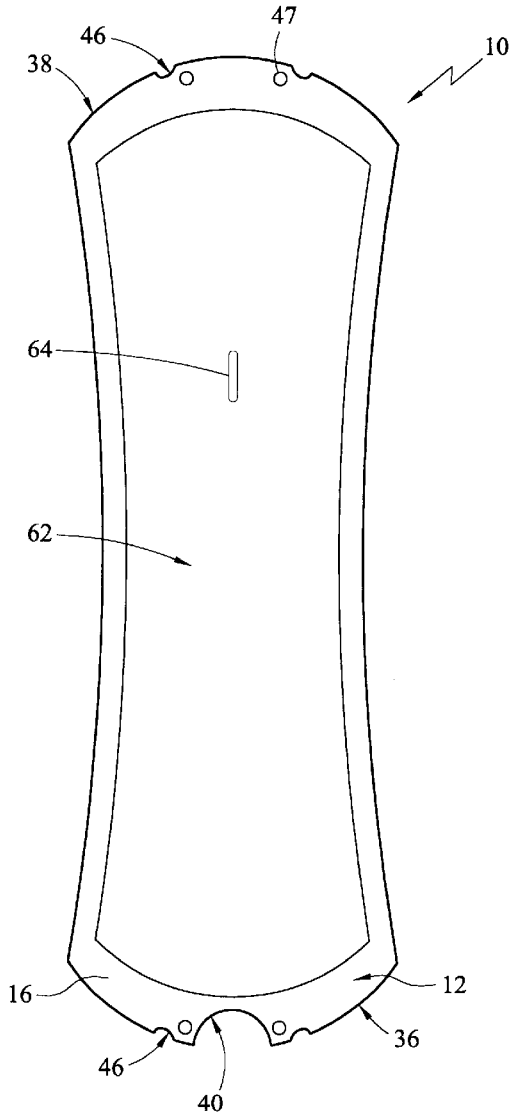
FIG. 2 shows a bottom view of the present invention.
Figure 3:
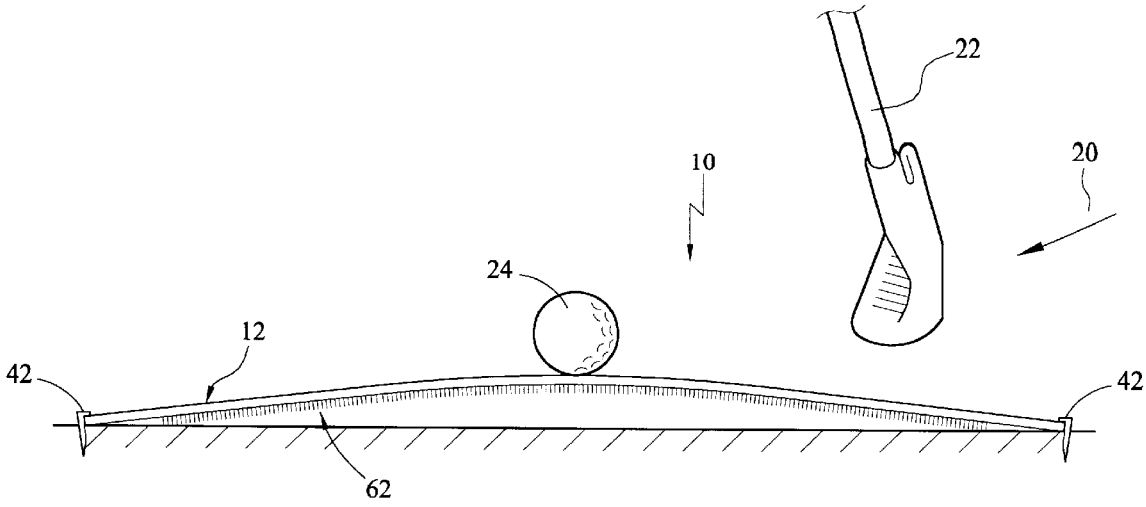
FIG. 3 is a side view of the present invention in use showing the base placed in a convex position.

With reference to FIGS. 1 through 4, where like elements have been given like numerical designations to facilitate understanding of the present invention, the ball support and golf swing aid for golf practice is designated generally 10. In the preferred embodiment, ball support 10 has a substantially flat base 12 having a smooth top surface 14 and a bottom surface 16. Base 12 should be made of a resiliently deformable, translucent material, such as polyethylene plastic, that is capable of being placed in a flexible convex shape (as shown in FIG. 3) and maintaining that shape during use. The thickness of base 12 should be sufficient to provide support to base 12 when in the convex position, yet thin enough to allow a golfer to bend base 12 with his or her hands. In the preferred embodiment, base 12 is a rectangular base having dimensions of approximately six inches wide by fourteen inches long and one-eighth of an inch thick. Although other configurations can work equally as well, the inventor has found that the above configuration generally provides a good base 12 for the present invention 10. The size of base described above provides sufficient hitting surface and allows base 12 to be easily bent into an arch or low bell curve-like shape. For some golfers, base 12 being twenty inches or more in length may be more appropriate. The longer base 12 is in recognition of the fact that golfers, particularly new golfers, tend to hit short of their mark. A problem that can be encountered with the shorter base 12 is that persons hitting short are more likely to hit the end of base 12, causing it to move forward. A longer base 12 provides more slide and cushioning room for the golfer who does hit short. Although base 12 can function with other shapes, such as circular or oval, a rectangular shape is generally better suited for obtaining the desired convex bend.

In the preferred embodiment, base 12 has two alignment lines 18 for assisting the golfer in aligning the longitudinal axis of base 12 with the preferred direction of travel of the ball. The two alignment lines 18 can be on the top surface 14 and extend along the entire longitudinal length of base 12. The use of two lines 18 generally makes it easier for the golfer to align base 12 than just one line. To prevent damage to the alignment lines 18 during use (i.e., from the golf club hitting the alignment lines 18) the lines 18 can be embedded into the base, made integral with the base or be placed into small channels cut into the base. In the preferred embodiment, the alignment lines can be of a color that contrasts with the color of base 12 to make them easy for the golfer to see. The alignment lines can be made from dies or paints that sufficiently bond with base 12 such that the action of the club hitting the base 12 will not remove the alignment lines 18. Alternatively, alignment lines 18 can be attached to bottom surface 16 if base 12 is sufficiently translucent to allow the golfer to see the alignment lines 18 through base 12 when in a standing position (i.e., six or more feet above the base 12). Placing alignment lines 18 on bottom surface 16 reduces the likelihood that a golf club will damage alignment lines 18 during use. If located on the bottom surface 16, alignment lines 18 can be one or more strips of colored plastic tape disposed along and parallel with the longitudinal axis of base 12. In use, target line 18 should be orientated in the direction the golfer wants the ball to go, to provide a visual guide to the golfer. Swing path 20 denotes the path that golf club 22 should take in order to properly strike golf ball 24. Additionally, the inventor has found that base 12 can be made of a "glow-in-the-dark" material to facilitate use of the device at night or in low light conditions.

In the preferred embodiment, top surface 14 of base 12 has recess 26 located on top surface 14 of base 12 for receiving ball 24 and holding it in place during use of the present invention 10. Recess 26 should be sized to allow ball 24 to be supported such that ball 24 contacts top surface 14 on top edge 28 of recess 26. Recess 26 can include a centrally located through hole 30 at the bottom of recess 26 for receiving a conventional golf tee (not shown).

To facilitate placement of golf ball 24 on recess 26, the preferred embodiment of the present invention includes a ball placement mechanism 32, which can comprise a ball channel 34 cut into the top surface 14 of base 12. Ball channel 34 should interconnect one or more of the opposing ends 36 and 38 of base 12 with recess 26. As shown in FIG. 1, the preferred embodiment utilizes one ball channel 34 that interconnects end 36 with recess 26. The ball placement mechanism 32 can also include ball entry port 40 for ease in getting ball 24 into channel 34. Ball placement mechanism 32 allows the golfer to slide ball 24 along the grass or ground surface with his or her golf club 22 or foot to entry port 40 and into and along channel 34 to recess 26 without having to bend over and pick up ball 24 every time he or she wants to make a shot. Preferably, but not required, the width of channel 34 is equal to or less than the width of ball 24 and of a depth so that the channel sides support ball 24 in a manner that the channel bottom does not interfere with the movement of ball 24 along channel 34. The inventor has found that a channel 34 having a width at the top of channel of approximately ¾ inch and a depth, as measured from top surface 14 to the channel bottom of approximately 1/16 inch works well. The use of the ball placement mechanism 32 reduces wasted time and can substantially reduce back fatigue to allow the golfer to extend the time in which he or she is actually practicing taking shots.

Figure 5:
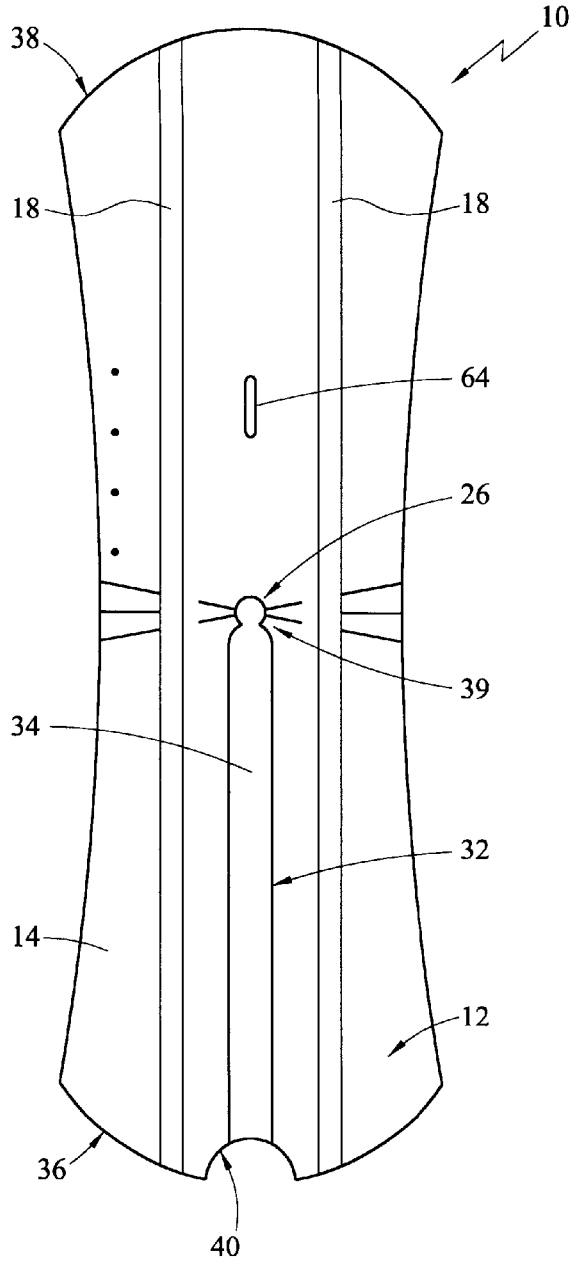
FIG. 5 is a top view showing the ball support and golf swing aid having a pinched in area near the recess.
Figure 6:
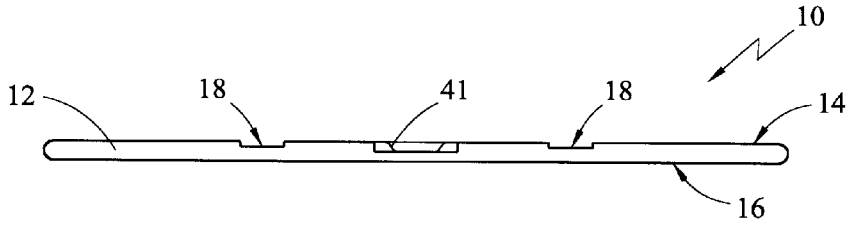
FIG. 6 is a end view showing the sides of the channel cut at an angle to facilitate the golf ball staying in the channel.

To facilitate movement of the golf ball from the ground surface to recess 26, the preferred embodiment should have a channel edge that is shaped so that the thickness of channel 34 at ball entry port 40 is close to or essentially flat against the ground. The less thickness of ball entry port 40 will make it easier for the golfer to push ball 24 onto channel 34. Near where channel 34 joins recess 26, channel 34 can comprise a pinched in area 39, shown in FIG. 5, of narrower width and shallower depth to prevent golf ball 24 from rolling back down channel 34 after placed in recess 26. The sides of channel 34 can be cut at an angle 41, as shown in FIG. 6, to further facilitate ball 24 staying in channel 34.

Other configurations are possible. For instance, the width of channel 34 near ball entry port 40 can be wide enough that ball 24 enters channel 34 on the bottom of channel 34 and then is rolled up the sides of channel 34. With this configuration, the width of channel 34 near ball entry port 40 can be nearly as wide as the width of ball support 10 itself. Although the drawings show channel 34 placed essentially along the longitudinal axis of ball support 10, the channel could be placed at or near the transverse axis or anywhere between the transverse and longitudinal axises (i.e., from recess 26 to one of the corners). With the channel 34 placed on or near the longitudinal axis, ball 24 entry into and movement along channel 34 is made easier when ball support 10 is in the convex shape. Near where channel 34 joins recess 26, other means of keeping ball 24 from rolling back along channel 34 are possible. For instance, channel 34 can include a barrier placed transversely across channel 34 near recess 26 that ball 24 must go over before entering recess 26.

Opposing ends 36 and 38 of base 12 can be shaped and configured to improve the ability to base 12 to stay in place when the golfer hits ball 24. Occasionally, even good golfers hit short of ball 24. When using the present invention, the elongated shape, convexed configuration and flexible nature of base 12 will generally prevent base 12 from moving forward during the typical shot. However, when a golfer hits a short shot hard, base 12 could move forward, even through the air for several feet. To provide additional resistance to forward movement, the present invention 10 can also comprise ends 36 and 38 configured in a convex shape, as shown in FIGS. 1 and 2. The inventor has found that the convex shape of ends 36 and 38 does provide additional resistance to forward movement. The use of convex shaped ends 36 and 38 further benefits the use of the invention by providing improved bounce characteristics. In general, curved ends 36 and 38 results in less bounce due to the way base 12 contacts the ground surface. When the golfer makes a good hit, base 12 will tend to bounce, what little it does, straight up. When the golfer makes a poor hit, curved ends 36 and 38 provides a more forgiving base 12 that does not move out of place as much as the base having a straight edge. The curvature of ends 36 and 38 should be slight, as shown in FIGS. 1 and 2. Although the only part touching the ground surface will be the apex, the slight curvature of ends 36 and 38 and the low arch-like profile of base 12 will prevent base 12 from "teetering" on its apex.

Figure 4:
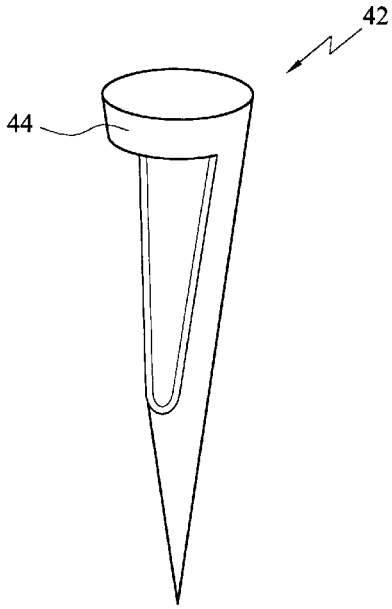
FIG. 4 is a perspective view of the stake of the present invention.

To further prevent forward movement of base 12, the golfer can utilize a device for holding base 12 stationary. One such device is stake 42 shown in FIG. 4. Although other shapes can also work, stake 42 can be generally conically shaped to facilitate entry of stake 42 into the ground to anchor base 12. To assist with holding base 12 in place, a side of stake 42 can be cut away (as shown in FIG. 4) to provide a lip 44. When stake 42 is pushed into the ground, the underside of lip 44 will abut against the top surface 14 of base 12 and hold base 12 in place during use. Base 12 can also comprise one or more stake areas 46 at ends 36 and 38 that are shaped and configured to receive stake 42. As shown in FIG. 1, stake areas 46 can be located where alignment lines 18 intersect ends 36 and 38. The present invention 10 can, in addition to or as an alternative to stakes 42, utilize one or more nail openings 47 to hold base 12 in place while practicing golf shots. Nail openings 47 can be sized to accept standard nails (i.e., six inch common nails) or their equivalent so that the golfer can insert the nail into nail openings 47 to hold the base in place. Depending on the size of the stakes 42 or nails, it may be beneficial to use stakes 42 in short grass and nails through nail openings 47 in taller grass conditions.

As shown in FIG. 1, the present invention 10 can also include devices for assisting the golfer improve his or her golf swing for shots that are other than a straight shot. Opposing sides 48 and 50 of base 12 can be concavely shaped to allow the golfer to rotatably align his or her body with sides 48 and 50 for certain shots. Transverse line 52 can be located across the center of base 12, extending from sides 48 to 50, to make it easier for the golfer to know where to stand for the middle of the base 12 when he or she desires to practice straight shots. Transverse angle marks 54, located on either side of transverse line 52 on sides 48 and 50 of base 12, can be used by the golfer to assist him or her with working the ball. The golfer can use transverse angle marks 54 to align the face of the golf club for intentional curving (i.e., hooks and slices). Located at the forward end 38 of base 12 is a longitudinal mark 56 that is on the longitudinal axis of base 12, which can be used by the golfer, along with alignment lines 18, to align the longitudinal axis of base 12 with the preferred direction of travel for ball 24. On either side of longitudinal mark 56 a pair of longitudinal angle marks 58 can be used to facilitate the golfer practicing shots that are at an angle to the longitudinal axis of base 12 (i.e., hooks and slices). Corresponding longitudinal angle marks 58 can also be utilized at the opposing end 36 of base 12 to further facilitate such practice. Along side 50 of base 12 can be located one or more ball forward marks 60 that the golfer can utilize when practicing striking ball 24 slightly ahead of the center of ball 24 for practicing various chip shots.

To further improve the functionality of the present invention 10, it can include dampening mechanism 62, such as foam, rubber or other compressible materials, attached to or integral with bottom surface 16 of base 12 to provide additional benefits when the device is used on a hard surface, such as asphalt or concrete. Specifically, the placement of dampening materials 62 on bottom 16 of base 12 can reduce or eliminate the slapping-like noise that results from bottom 16 of base 12 hitting the hard surface when the club head strikes top surface 14 of base 12. Base 12 can also include a small rectangular opening 64 forward of conical recess 26, as shown in FIGS. 1 and 2. Rectangular opening 64 should be sized such that the stem of a conventional golf tee can be placed inside rectangular opening 64. The width of rectangular opening 64 can be approximately the same as the width of the golf tee stem to help stand the golf tee up. The length of rectangular opening 64 should be sufficient to allow the golf tee to bend when hit. The advantage of rectangular opening 64 is that it will facilitate the golf tee bending over, instead of breaking. As shown in the figures, rectangular opening 64 can be placed forward, in the direction of desired ball travel, of recess 26. With use of rectangular opening 64, a hole in conical recess 26 is not required.

In use, a golfer will select a place from which to practice his or her golf swing. Due to the nature of the present invention 10 the golfer is not limited to a turf area. Typically, the golfer will place base 12 in a convex shape, as shown in FIG. 3. Because base 12 is made from a relatively thin and flexible plastic material which can hold its shape, the golfer can merely use his or her hands to manually bend base 12 into the desired curvature. After obtaining the desired shape for base 12, the golfer places it on the ground such that the alignment lines 18 are aimed in the direction the golfer wants golf ball 24 to travel. The golfer then places golf ball 24 into recess 26, either with his hand or by utilizing the ball placement mechanism 32, and places himself or herself into a standing position to swing at ball 24 with golf club 22.

The golfer will swing golf club 22 towards ball 24 along preferred swing path 20. Golf club 22 will slide along smooth top surface 14, displace base 12 downward and strike ball 24. Having base 12 in a convex shape provides the golfer with a cushioned, spring-like resistance "(i.e., such that base 12 will rebound upward after being hit in a manner not unlike an inverted automobile leaf spring)" which will prevent or reduce the amount of jarring shock experienced by the golfer, thereby reducing the likelihood of injuries or equipment damage from such jarring, and simulate the feel of a golf swing on a natural fairway.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

I claim:

1. A ball support and golf swing aid for golf practice, comprising:

a substantially flat elongated base having a pair of opposing ends, a pair of opposing sides, a smooth top surface and a bottom surface, said base being suitably dimensioned and made of a resiliently deformable material suitable for convexly disposing said base and providing the golfer with a cushioned, spring like resistance which will prevent or reduce the amount of jarring shock experienced by the golfer, thereby reducing the likelihood of injuries or equipment damage from such jarring, and simulate the feel of a golf swing on a natural fairway;

alignment means on said base for aligning said base with a preferred direction of travel for a golf ball that is to be hit from said base by a golf club, said alignment means oriented substantially parallel to a longitudinal axis of said base;

a recess in said top surface, said recess sized so that a conventional golf ball supported on said recess contacts said top surface on a top edge of said recess; and ball placement means on said base for placing said golf ball on said recess, said ball placement means interconnecting said recess with at least one of said pair of opposing ends of said base.

2. The ball support and golf swing aid according to claim 1, wherein said base further comprises cushioning means attached to said bottom surface for cushioning said base when said base impacts a substantially hard surface.

3. The ball support and golf swing aid according to claim 1, wherein at least one of said pair of opposing ends is convexly shaped to provide stationary support for said base when the golfer hits said golf ball from said base.

4. The ball support and golf swing aid according to claim 1 further comprising stationary means for holding said base stationary when the golfer hits said golf ball from said base.

5. The ball support and golf swing aid according to claim 4, wherein said stationary means comprises at least one stake placed at said at least one of said pair of opposing ends of said base.

6. The ball support and golf swing aid according to claim 5, wherein said stake is generally conically shaped and is configured to abut said top surface at said end of said base.

7. The ball support and golf swing aid according to claim 1, wherein at least one of said opposing sides of said base is concavely shaped to assist the golfer in proper body rotation when the golfer is to hit said golf ball from said base.

8. The ball support and golf swing aid according to claim 1 further comprising one or more shot alignment marks on said top surface of said base.

9. The ball support and golf swing aid according to claim 1 further comprising an opening through said base, said opening sized and configured to pass the stem of a conventional golf tee and to reduce the likelihood of breakage of said golf tee when the golfer hits said golf ball from said golf tee.

10. The ball support and golf swing aid according to claim 9, wherein said opening is spaced apart from said recess.

11. The ball support and golf swing aid according to claim 1, wherein said recess is centrally disposed on said base.

12. The ball support and golf swing aid according to claim 1, wherein said ball placement means comprises a channel in said top surface of said base, said channel sized and configured to facilitate movement of said golf ball from said at least one end to said recess.

13. The ball support and golf swing aid according to claim 1, wherein said ball placement means comprises a ball entry port located at said at least one end to facilitate entry of said golf ball onto said ball placement means.

14. A ball support and golf swing aid for golf practice, comprising:

a substantially flat elongated base having a pair of opposing ends, a pair of opposing sides, a smooth top surface and a bottom surface, said base being suitably dimensioned and made of a resiliently deformable material suitable for convexly disposing said base and providing the golfer with a cushioned, spring like resistance which will prevent or reduce the amount of jarring shock experienced by the golfer, thereby reducing the likelihood of injuries or equipment damage from such jarring, and simulate the feel of a golf swing on a natural fairway, at least one of said pair of opposing ends being convexly shaped to provide stationary support for said base when the golfer hits said golf ball from said base, at least one of said opposing sides of said base being concavely shaped to assist the golfer in proper body rotation when the golfer is to hit said golf ball from said base;

alignment means on said base for aligning said base with a preferred direction of travel for a golf ball that is to be hit from said base by a golf club, said alignment means oriented substantially parallel to a longitudinal axis of said base;

a recess in said top surface, said recess sized so that a conventional golf ball supported on said recess contacts said top surface on a top edge of said recess; and ball placement means on said base for placing said golf ball on said recess, said ball placement means interconnecting said recess with at least one of said pair of opposing ends of said base.

15. The ball support and golf swing aid according to claim 14, wherein said base further comprises cushioning means attached to said bottom surface for cushioning said base when said base impacts a substantially hard surface.

16. The ball support and golf swing aid according to claim 14 further comprising stationary means for holding said base stationary when the golfer hits said golf ball from said base, said stationary means comprising at least one stake placed at said at least one of said pair of opposing ends of said base, said stake being generally conically shaped and configured to abut said top surface at said end of said base.

17. The ball support and golf swing aid according to claim 14 further comprising one or more shot alignment marks on said top surface of said base.

18. The ball support and golf swing aid according to claim 14 further comprising an opening through said base, said opening sized and configured to pass the stem of a conventional golf tee and to reduce the likelihood of breakage of said golf tee when the golfer hits said golf ball from said golf tee.

19. The ball support and golf swing aid according to claim 14, wherein said ball placement means comprises a channel in said top surface of said base, said channel sized and configured to facilitate movement of said golf ball from said at least one end to said recess.

20. The ball support and golf swing aid according to claim 14, wherein said ball placement means further comprises a ball entry port located at said at least one end to facilitate entry of said golf ball into said ball placement means.

* * * * *